United States Patent [19]

Armstrong

[11] 4,064,724

[45] Dec. 27, 1977

[54] SHEAVE FORMING METHOD

[76] Inventor: James E. Armstrong, 6170 Park St., Jacksonville, Fla. 32205

[21] Appl. No.: 726,764

[22] Filed: Sept. 27, 1976

Related U.S. Application Data

[63] Continuation-in-part of Ser. No. 600,585, July 31, 1975, abandoned.

[51] Int. Cl.[2] ..... B21H 1/04

[52] U.S. Cl. ..... 72/108; 29/159 R; 113/116 D

[58] Field of Search ..... 29/159 R; 113/116 D; 72/108, 110

[56] References Cited

U.S. PATENT DOCUMENTS

| | | | |
|---|---|---|---|
| 3,087,531 | 4/1963 | Pacak | 29/159 R |
| 3,335,597 | 8/1967 | Gobien | 29/159 R |
| 3,700,382 | 10/1972 | Pacak | 29/159 R |
| 3,893,818 | 7/1975 | Mickus | 29/159 R |
| 4,000,634 | 1/1977 | Hixson | 72/110 |

*Primary Examiner*—Lowell A. Larson

*Attorney, Agent, or Firm*—George H. Baldwin; Arthur G. Yeager

[57] ABSTRACT

A method of forming sheaves of the type used in moving and guiding wire in wiremills. A sheet steel blank is freely rotatably carried on an arbor between two driven forming rollers and the rollers have peripheral edges which, when the rollers are forced toward the blank form an initial groove and progressively deepen the groove and spread the lips bounding the groove, while polishing and hardening the groove surfaces. The machine includes an arbor for freely rotatably holding a blank for the sheave, carriages for holding forming rollers and motor means for driving the rollers, and means for forcing the rollers into the blank which is disposed therebetween.

5 Claims, 5 Drawing Figures

TOP VIEW 1st STEP

CYL B
HYD
CYL A
HYD
CYL C
AIR
TOP VIEW
2nd STEP

SHEAVE FORMING METHOD

This application is a continuation-in-part of my application Ser. No. 600,585, filed July 31, 1975 entitled SHEAVE FORMING METHOD AND MACHINE, now abandoned.

Various means have been employed for forming or fabricating steel sheaves for moving and guiding wire in wiremills. Such sheaves must be held to close tolerances, should have polished grooves with wear-resistant walls and frequently are required to exhibit high strength. Such sheaves have been heretofore fabricated by casting, following by machine and grinding to provide true central bearing openings and precision grooves, or by machining from heavy plate stock, followed by such grinding. The groove surfaces are frequently heat treated to provide surfaces hardness.

Sheaves formed of high strength steel with the required precision in the alignment of the groove and in its shape by such prior art methods tend to be very costly, and expensive, complicated precision machines are necessarily used for the time-consuming machining and grinding operations.

It has been known to form pulleys for V-belts by clamping a steel washer in a rotatable clamp and by forcing sharp edged splitting dies into the peripheral surface of the washer as it rotates to split a groove therein and finally rolling the spread apart outer edges of the groove inwardly toward the slitting die surfaces for the intended purposes of smoothing the groove surfaces and causing them to conform to the shape of the die, as exemplified in Gobien U.S. Pat. No. 3,335,597.

In contrast to this known method, the present invention relates to the forming of sheaves by a rolling operation in which the radiused edges of forming rollers are forced into the peripheral edge of a rotating blank with sufficient force that the surfaces of the groove being rolled into the blank hug the surfaces of the rollers throughout the rolling operation. The result is a sheave having a round-bottomed groove, the surfaces of the groove having been work hardened and polished by the continuous contact with the forming rollers, and the groove shape being true and precise. While the Gobien operation provides some work hardening of the rims of the pulleys, it provides very little if any work hardening of the groove surfaces and substantially no hardening of the bottom of the groove so that such pulleys, while suitable for V-belt drives, if subjected to the forces applied to wiremill sheaves, would simply split in two or wear away very rapidly. In contrast, sheaves made in accord with the present invention at low cost have proved to have long life and almost undetectable wear over long periods of use in wiremill operation, successfully substituting for specially heat treated sheaves costing about ten times as much.

It is an object of this invention to provide a simple and rapid method of fabricating such sheaves with precision.

It is a specific object of the invention to provide a machine capable of the rapid forming of sheaves of different diameters, and with different groove depths, with only simple adjustments.

A further object of the invention is to provide a machine and method for so forming wire handling sheaves as to provide substantial hardening of the groove surfaces as a result of the forming thereof rather than by heat treating.

A general object of the invention is to decrease the time required, costs of materials, handling costs, and the labor in fabricating precision wire-handling sheaves.

According to the invention, a blank for a sheave is bored to establish the bearing opening, the blank is mounted on an arbor for rotation on the axis of the opening, and, with no previous scoring to provide entry into the peripheral surface of the blank, forming rollers are pressed against and are generally forced into the peripheral surface of the blank, dividing the edge portion of the blank into lip portions, and then spreading apart the lip portions to form the final groove between such lips.

The novel features which are believed to be characteristic of this invention are set forth with particularlity in the appended claims. The invention itself, however, both as to its organization and method of operation, together with further objects and advantages thereof, may best be understood by reference to the following description taken in connection with the accompanying drawings, in which:

Figure 1:
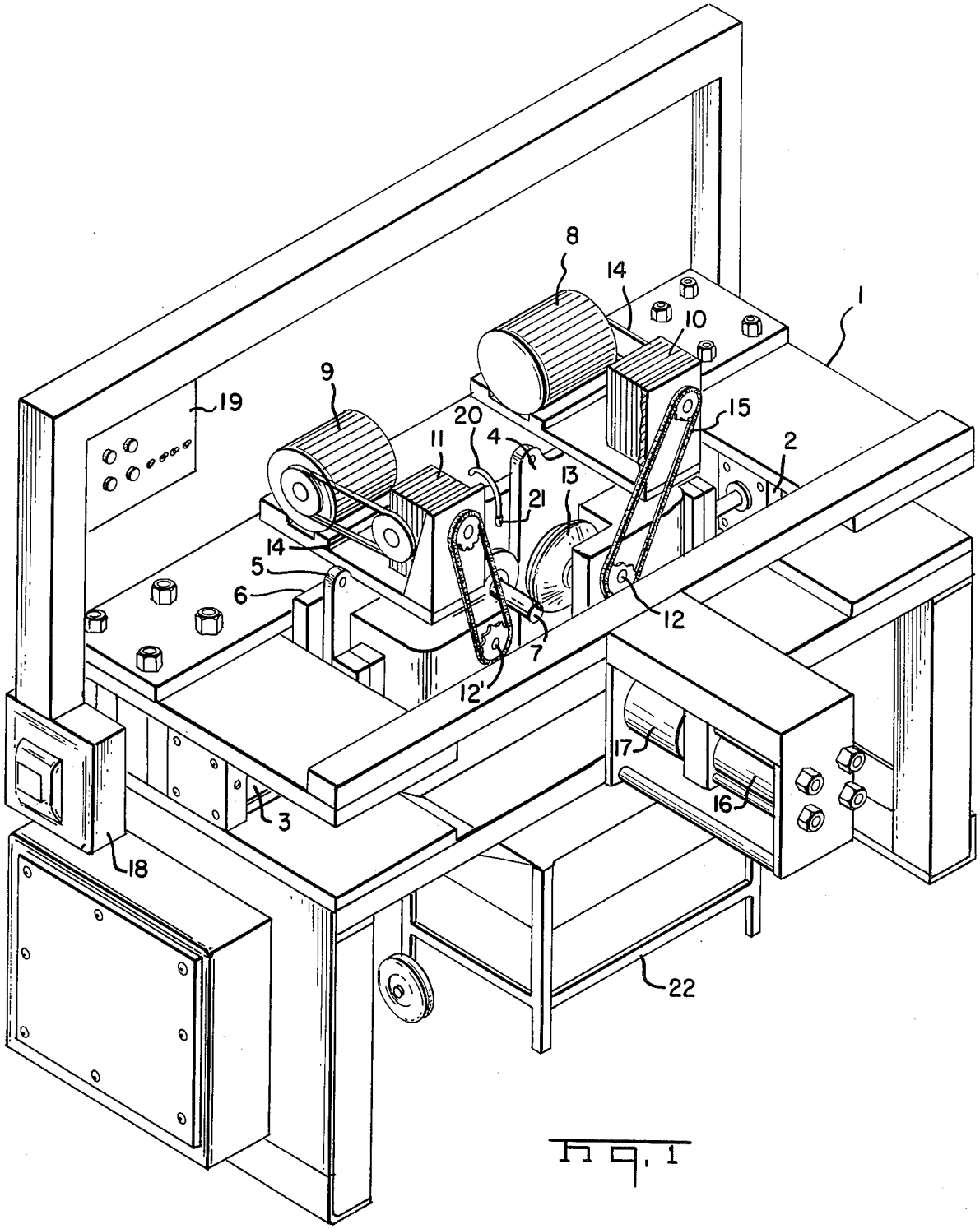
FIG. 1 is a perspective view of a sheave forming machine embodying the invention.

A machine in accord with the invention is shown in FIG. 1 wherein a heavy frame 1 fixedly carries two hydraulic pistons 2 and 3 arranged to control carriages 4 and 5 which are mounted by rollers on a horizontal track 6 for movement toward and away from an arbor 7 adapted to carry a sheave blank. Electric motors 8 and 9 and geared transmissions 10 and 11 are mounted on the respective carriages. Each carriage is further supplied with a shaft, such as shaft 12 journalled in carriage 4, for carrying thereon a forming roller 13. Suitable belt and pulley drives 14 and belt or chain and pulley drives 15 connect the motors to the transmissions and the transmissions to the shafts 12 for rotationally driving the forming rollers 13 which are keyed on the shafts.

An air cylinder 16 is fixed to frame 1 in axial alignment with arbor 7. The air cylinder is operative to advance a hollow cup element 17 toward arbor 7 to clamp a sheave blank thereon and to retract the element 17 after forming of the sheave to permit its removal.

The machine is provided with electrical power from a source 18, as well as with connections to sources of compressed air and hydraulic pressure fluid which are not shown in FIG. 1, and with suitable controls 19 for supplying power in such forms to the motors and hydraulic and air cylinders. Means 20 is provided for spraying lubricant under pressure from a nozzle 21 onto the blank and/or the rollers 13, and a moveable drip pan 22 for collecting the lubricant is preferably provided under the work area.

Figure 2:
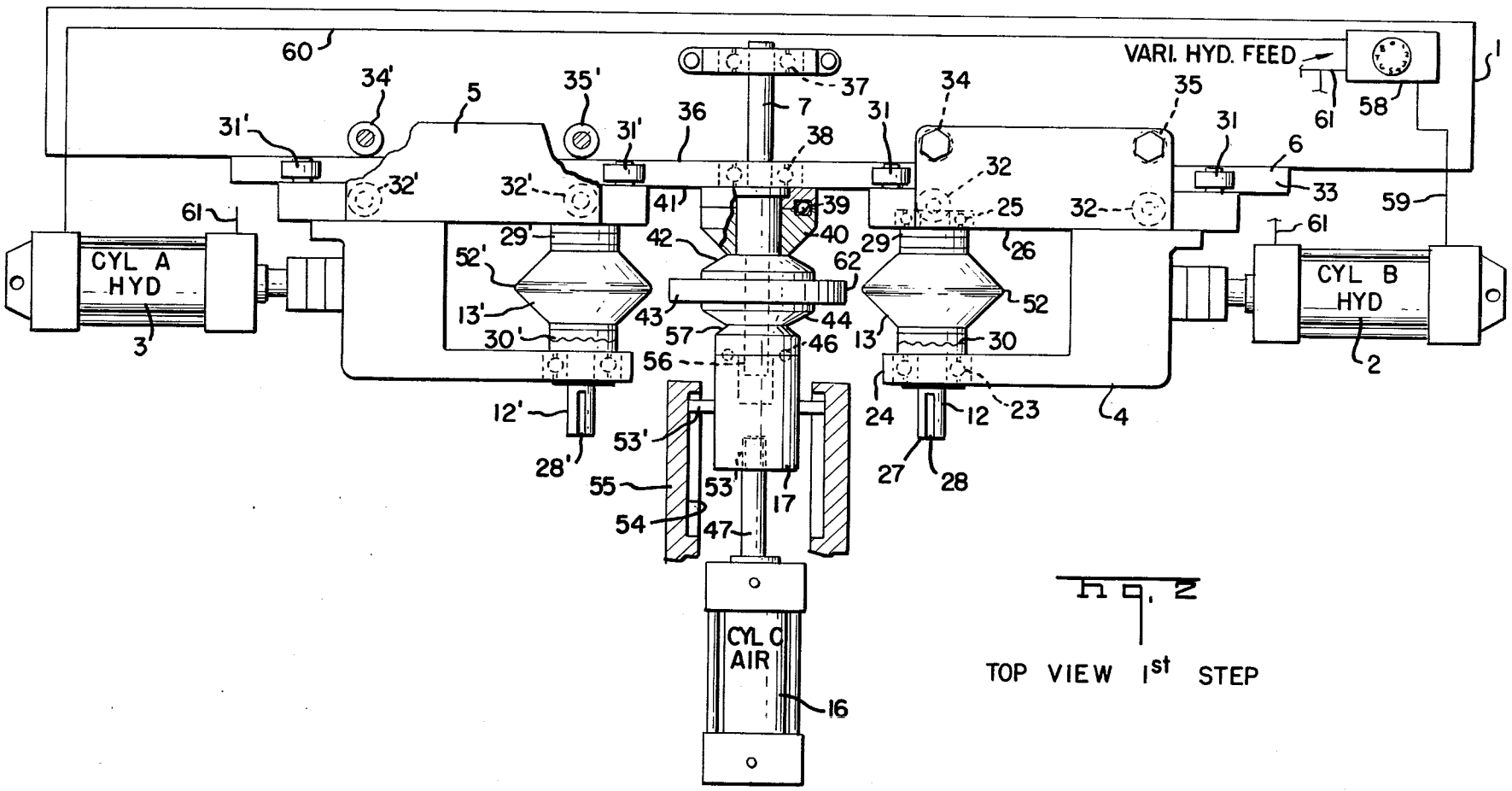
FIG. 2 is a plan view of the machine with certain parts shown in section or omitted for clarity.
Figure 3:
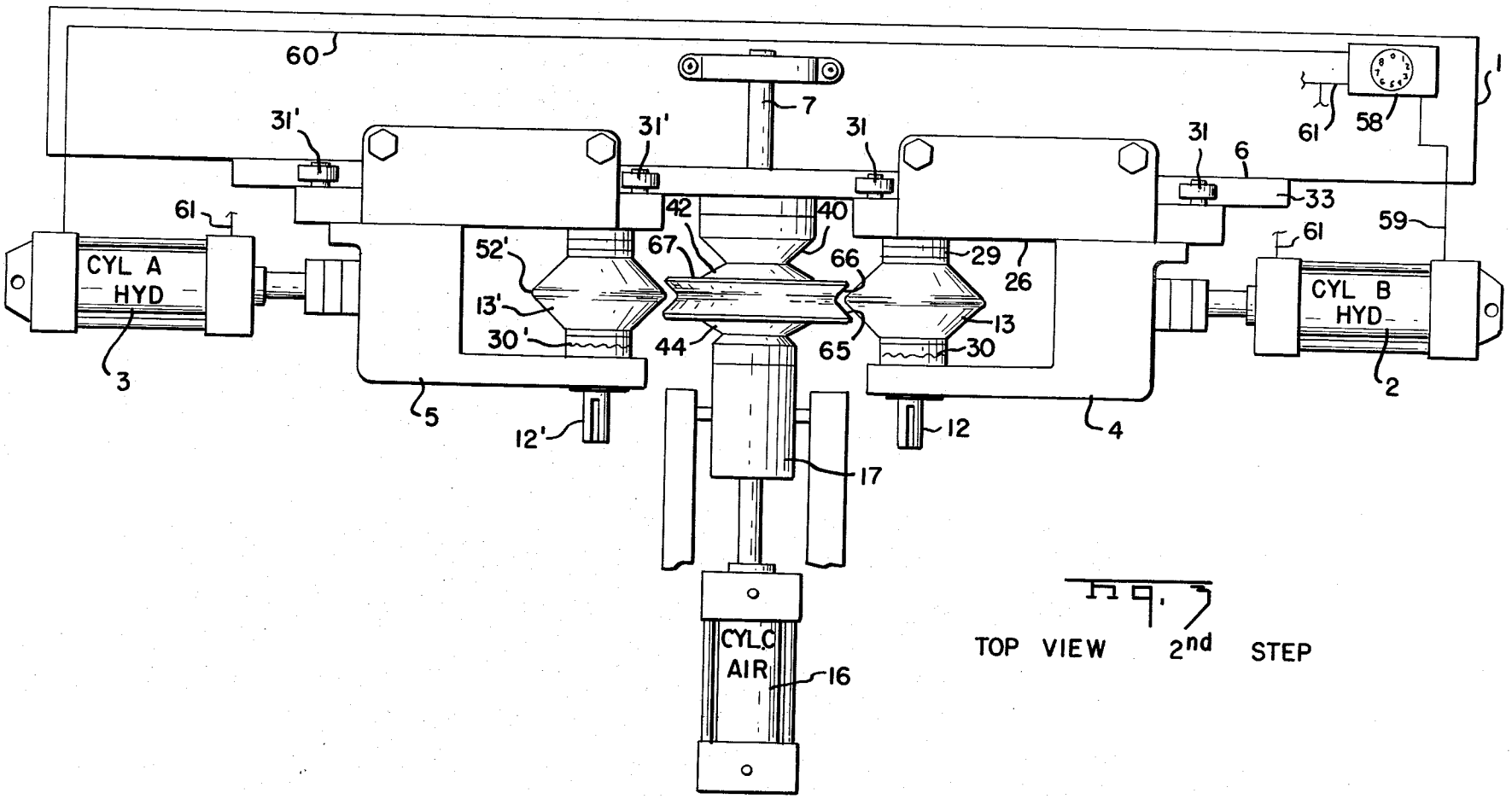
FIG. 3 is a similar plan view showing the formation of a sheave.

Further details of the machine are shown in FIGS. 2 and 3, wherein it will be seen that forming roller 13 is mounted on shaft 12, and that the shaft is supported in ball bearing 23 in arm portion 24 of carriage 4 and in ball bearing 25 in base portion 26 of the carriage.

The forward end portion 27 of the shaft 12 is adapted to carry a pulley wheel comprising a part of drive 15 and is provided with a keyway 28 for keying the pulley wheel thereto. Suitable shimming washers 29 are provided on opposite sides of forming rollers 13, including an adjustable take-up washer arrangement 30 for insuring that there be minimal play of the roller along the shaft. The roller is keyed to rotate with the shaft.

The carriage 4 is carried by rollers 31 which roll along the top 33 of track 6. Carriage 5 is partly broken away to show rollers 34 and 35 which engage against the back face 36 of the track. Each carrier is provided with such rollers for the top and back face of track 6, and each is further provided with similar rollers for the lower edge and lower back face of the track. Rollers 32, indicated in broken lines, are further provided to engage the front face 41 of the track. Each of these track-following rollers is preferably adjustable in position on the carriage, such as by mounting the rollers 31, 32, 34 and 35 on eccentrics fitted into aperatures in the carriage, the eccentric mounts being locked in position when adjusted, or by other well known means.

The carriages are thus mounted for movement along track 6 in carefully aligned and maintained paths, from which they should not be permitted to deviate by more than about 0.001 inches, and preferably less.

Arbor or mandrel shaft 7 is supported by frame 1 by a ball bearing 37 and from track member 6, which comprises a portion of the frame, by a ball bearing 38. A roller thrust bearing 39 is further provided disposed between a collar portion 40 integral with arbor shaft 7 and the front face 41 of track member 6. A back face plate 42 is disposed on shaft 7 against collar 40 to serve as a backing for working blank 43.

The blank 43 is in the form of a thick disc or short cylinder having a cylindrical central bore. The blank may be, typically, of vacuum cast low carbon steel plate stock, i.e. ASTM-A-36 carbon steel, or 515–70A pressure vessel steel, and the blank may be cut from 3/8 inch thick plate stock. The disc or short cylinder may have an outer diameter of between about 4 and 20 inches, typically, and the central bore and peripheral surfaces should be true and coaxial, preferably being bored and turned in a lathe. The bore should fit with no more than about 0.002 inch clearance on shaft 7. A bore and arbor shaft diameter of nominally one and one-quarter to one and one-half inches has proven satisfactory. It is desirable that the faces of the disc blank, or the ends of the short cylinder blank, should be flat, parallel and normal to the bore axis. It has been found, however, that the machine in forming the sheave or pulley wheel tends to correct for and to straighten blanks formed of plate stock which are bent out of flat by up to a few thousandths of an inch.

The blank is engaged on shaft 7, and a front circular face plate 44 having a bore to fit the shaft is positioned opposite back circular face plate 42 with the blank between these face plates. The face plates should be of equal diameters and are preferably otherwise identical.

A blank holding pressure assembly is provided which includes a hollow cup 17, of which the lip portion comprises a thrust bearing, such as ball bearing 46. The cup 17 is mounted to the rod 47 of compressed-air-operated cylinder 16. The cup may be advanced by suitable controls (not shown) to clamp the blank between face plates 44 and 42, and it may be retracted to permit removal from shaft 7 of the face plate 44 and the sheave formed from the blank. A new blank and face plate 44 may be positioned on the shaft and the cup again advanced. Cup pressures against plate 44 of several hundred but somewhat less than one thousand pounds have proven satisfactory.

Figure 4:
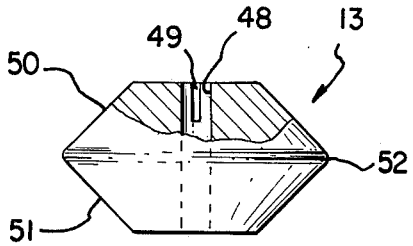
FIG. 4 is a side elevation on an enlarged scale and partially in section of a forming roller embodied in the machine.

A forming roller 13 is shown in FIG. 4. It is preferably of tool steel, has a typical outer diameter of 6 inches and a central through bore 48 of 1¼or 1½inch diameter which is provided with a keyway 49 for keyed mounting on shaft 12. The included angle between the frusto-conical faces 50 and 51 may be 90° if the sheave to be formed is for typical use in a wire mill. The outer edge 52 at which the faces meet is typically radiused to a 3/32 inch radius to form a sheave groove of desirable shape for wire handling. The roll is seen to be essentially of right symmetrical double frusto-conical configuration with an outer peripheral edge 52, at which the frusto-conical faces 50 and 51 meet, which is radiused to accord with the desired shape of the bottom of the sheave groove, a radius along the edge of between about 0.03 and about 0.2 inches being within an acceptable range. The faces may, depending upon the desired groove shape, include an angle of between about 45° to about 100° .

The roller 13 should be ground to true shape, and it should be hardened to mimimize wear.

The air cylinder is fixed to a forward part of frame 1, and cup 17 may be attached to rod 47 by screw threads 53, as seen in FIG. 2. The cup 17 carries guiding projections 53' engaged in grooves, such as groove 54, in fixed members, such as member 55, forming parts of frame 1, to prevent rotation of the cup and to maintain it in alignment. The cup is hollow as indicated to permit entrance of the end portion 56 of shaft 7 thereinto when the cup is moved toward the blank in the direction to engage its lip 57 with face plate 44. Lip portion 57 of cup 17 turns with plate 44 by rotating on bearing 46.

Hydraulic cylinders 2 and 3 are supplied with pressure fluid from a control and source 58, which includes an adjustable orifice valve supplying fluid under equal pressure into lines 59 and 60. Suitable fluid return lines 61 are further provided from the cylinders to the control source 58.

It will be understood that roller 13' is identical to roller 13, and that it is carried in the same way by a shaft 12' on carriage 5, and that the carriages 4 and 5 are identical, except that one is a right hand and the other a left hand carriage.

The rollers are retained in fixed positions by take up washers, such as seen at 30, and their peripheral edges 52 are as nearly as possible exactly aligned, i.e. the edges 52 of the two rollers should lie in a common plane normal to the axis of shaft 7. To this end, the end surface of one or the other of the rollers which is to be engaged with the shimming washers 29 may be ground off until, when the rollers are positioned against the washers, their edges are so aligned. The blank and rollers are so aligned with respect to each that the edges of the rollers come into contact with the outer cylindrical face 62 of the blank as nearly as possible exactly midway between the flat faces of the blank and, at least, within 0.002 or 0.003 inches of the centerline of this cylindrical outer peripheral face. When such alignment has been obtained, the drive motors 8 and 9 are energized to rotate both of rollers 13, 13' in the same direction and at substantially the same speed, which may be 800 to 900 r.p.m. for 6 inch diameter rollers, and hydraulic fluid is introduced into the lines 59, 60 at equal pressures, i.e. the lines 59 and 60 are connected in parallel to be both fed through the same control orifice, thereby to move the carriages inwardly toward each other until each of rollers 13 and 13' is in contact with the blank. With equal power supplied to drive the forming rollers, the speeds of the rollers automatically equalize when they engage the blank.

In the meantime a high temperature, high pressure lubricating oil is sprayed by means 20, 21 on the rollers and blank to lubricate and cool the areas in which the rollers contact the blank. With inadequate lubrication, there is a tendency of the rollers to weld to the blank, which may result in the pulling of small globs of steel from the blank, which globs remain welded to the rollers. The pitting of the surface of the groove being formed in the blank and the uneven roller surfaces carrying such globs are, of course, undesirable. High sulphur, high chlorine oils are known for lubricating rolling mill rolls for rolling steel plates, and such oils have been found suitable for use in lubricating the roller and blank surfaces in this invention. The pressure against the rollers is increased to up to about 8 tons and the rollers roll into the unmarked blank periphery indenting a smooth groove thereinto. The rollers are typically advanced into the blank at a rate controlled by the rate at which hydraulic fluid is supplied to the cylinders such that a groove is formed increasing in depth at a rate of approximately three-quarters of an inch per minute. In effect, the rollers divide the peripheral portions of the blank into two lips which are gradually spread more and more apart but with the lips continuously hugging the conical faces of the forming rollers. FIG. 3 shows the machine after the rollers have progressed sufficiently into a blank (such as blank 43 of FIG. 2) to have formed it into a completed sheave 67 wherein the lips 65, 66 define between them a V groove having a radiused bottom and walls at 90 degrees to each other.

Figure 5:
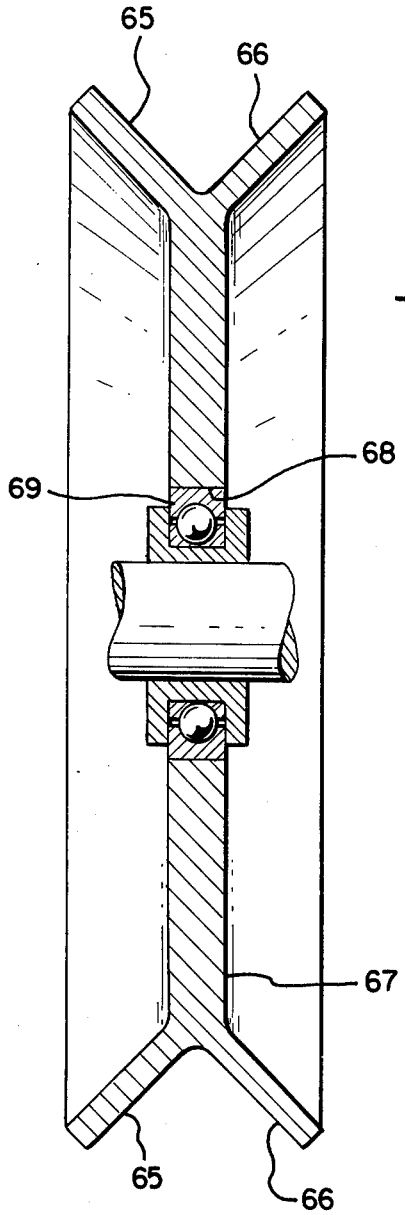
FIG. 5 is a sectional view of a sheave formed in accord with the method of this invention.

FIG. 5 shows in cross-section wire handling sheave 67 wherein the lips 65, 66 define a 90 degree wire receiving groove between them, the bottom of the groove being radiused at a radius of, for example, 3/32 inches. The groove surfaces will have been polished and hardened by the action of the forming rolls, producing a typical hardness of about 62 Rockwell.

The central opening 68 of the sheave is seen to be provided with a ball bearing hub 69 press fitted therein. The central opening originally existed in the blank to fit arbor shaft 7. Depending upon the amount of working of the blank by the rollers, the original central opening may have been enlarged by one or two thousandths of an inch, or under some circumstances perhaps somewhat more. Depending upon the precision required, it may be appropriate to rebore or otherwise true the central bore, and it may be enlarged slightly to adjust the diameter to receive a bearing of a standard outer diameter with an appropriately snug press fit thereinto.

While the invention has been described with respect to a certain specific embodiment, it will be appreciated that many modifications and changes may be made by those skilled in the art, without departing from the spirit of the invention. It is intended, therefore, by the appended claims to cover all such modifications and changes as fall within the true spirit and scope of the invention.

What is claimed as new and what is desired to secure by Letters Patent of the United States is:

1. The method of forming wiremill sheaves which comprises forming a blank by boring an axial cylindrical bearing opening through a steel plate workpiece roughly cylindrical in outline and said workpiece having a diameter of between about 2 and 50 times the thickness dimension of said plate, machining the cylindrical surface of the blank to the shape of a right cylinder coaxial with the axis of said opening, mounting said blank on arbor means fitting said opening, pressing circular face plates retained on such arbor means against the opposite faces of the blank with a force of at least several hundred pounds, said face plates being of equal diameters, forcing, with forces of the order of several tons toward and into the peripheral surface of said blank midway between the faces of the blank, the peripheral edges of two diametrically opposed driven forming rolls of hardened tool steel, said rolls being at least substantially identical and each being of right symmetrical double frusto-conical configuration with a peripheral edge centrally between the ends at which the conical faces meet at an included angle of between about 45° and 100°, such edge being radiused to a radius of about 0.03 to about 0.2 inches, while drivingly rotating said rollers at the same speeds to provide rotational movement of said peripheral edges of the order of hundreds of feet per minute and while maintaining the axes of rotation of said blank and rollers parallel and in the same plane, such forcing being balanced between said rollers and the force being applied perpendicularly of said axes, and the forcing causing initial grooving of the blank and progressive deepening of such groove and dividing of the peripheral portion of the blank into two outturned lips, continuously applying a lubricant resistant to high temperatures and high pressure to the contacting surfaces of the blank and rollers while said groove is being so formed, and maintaining sufficient force of the forming rolls against the blank to cause such lips to hug and to be polished by said faces of the forming rolls, whereby said lips are caused to define therebetween a polished wire-receiving sheave groove having a bottom rounded to said radius and having hardened wear resistant surfaces.

2. The method of forming a steel sheave of a thick disc of steel plate material having parallel faces, and axial bore and a rectilinear cylindrical perhipheral edge which comprises: mounting said disc in a fixed location for rotation on its axis, forceably moving two operative identical forming rollers which have right double conical surfaces, which are oppositely disposed with respect to said disc, and which have axes parallel to said disc and which lie in a plane which includes said disc axis, and which rollers further have peripheral edges lying in a plane which is operatively midway and parallel to said disc faces, such moving being in directions toward and against said peripheral edge and through said edge into the disc, while power-rotating said rollers on their respective axes in the same direction of rotation, and forcing said rollers into said disc with a force of at least several tons sufficient to cause a substantially V-shaped groove defined between side faces to be roll formed in the disc and to cause said conical roller surfaces to be hugged by said side faces of the groove throughout the roll forming of the groove.

3. The method according to claim 2 wherein said peripheral edges of said forming rollers are radiused to between about 0.03 and 0.2 inches and wherein a high temperature and high pressure resistant lubricant is continuously supplied to the contacting surfaces of the disc and rollers while said groove is being so formed thereby to prevent the welding of the disc to the rollers.

4. The method of forming a steel sheave of a thick disc of steel plate material having parallel faces, an axial bore and a rectilinear cylindrical peripheral edge which comprises: mounting said disc in a fixed location for rotation on its axis, forceably moving under equal forces a plurality of operatively identical forming rollers which have right double conical surfaces which are evenly spaced outwardly around said disc and which have parallel axes which are parallel to said disc axis, and which rollers further have peripheral edges lying in a plane which is operatively midway between and parallel to said disc faces, such moving being in directions radially toward and against said peripheral edge of said disc and therethrough into the disc, while power-rotating said rollers on their respective axes in the same direction of rotation and forcing said rollers into said disc with a force of at least several tons sufficient to cause a substantially V-shape groove defined between side faces to be roll formed in the disc and to cause said conical roller surfaces to be hugged by said side faces of the groove throughout the roll forming of the groove.

5. The method according to claim 4 wherein said peripheral edges of said rollers are radiused to between about 0.03 and 0.2 inches.

* * * * *